US006880499B2

(12) United States Patent
Hoffmann et al.

(10) Patent No.: US 6,880,499 B2
(45) Date of Patent: Apr. 19, 2005

(54) DEVICE FOR DISPLACING THE CYLINDER BLOCK AND CYLINDER HEAD WITH RESPECT TO THE CRANKCASE

(75) Inventors: Werner Hoffmann, Oberschindmaas (DE); Stefan Kühn, Chemnitz/Grüna (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 0 days.

(21) Appl. No.: 10/436,308

(22) Filed: May 12, 2003

(65) Prior Publication Data

US 2004/0035376 A1 Feb. 26, 2004

(30) Foreign Application Priority Data

May 10, 2002 (DE) ..... 102 21 334

(51) Int. Cl.[7] ..... F02B 75/04
(52) U.S. Cl. ..... 123/48 C; 123/78 C
(58) Field of Search ..... 123/48 R, 48 C, 123/78 R, 78 C

(56) References Cited

FOREIGN PATENT DOCUMENTS

EP 0 426 540 A1 5/1991

OTHER PUBLICATIONS

"Kluges Köpfchen" Auto–Zeitung Oct. 2000, pp. 68, 69.

*Primary Examiner*—Noah P. Kamen
(74) *Attorney, Agent, or Firm*—Collard & Roe, P.C.

(57) ABSTRACT

A device for displacing a cylinder block and cylinder head vs a crankcase. The cylinder block contains cylinders having an axis. In this case, the device comprises a plurality of bearing bridges extending across the cylinder block between the cylinders in a substantially straight line that is substantially perpendicular to the cylinder axis. In this case, each of the plurality of bearing bridges have a plurality of bearing passages. There are at least two setting shafts disposed in an upper region of the cylinder block in these bearing passages, and arranged in an alternating manner over a length of the crankcase. There are also a plurality of eccentrics which are coupled to the at least two setting shafts and supported on both sides of each of the cylinders. There are also a plurality of hollow support bars disposed in the cylinder block below the receiving bores.

10 Claims, 4 Drawing Sheets

Fig. 1
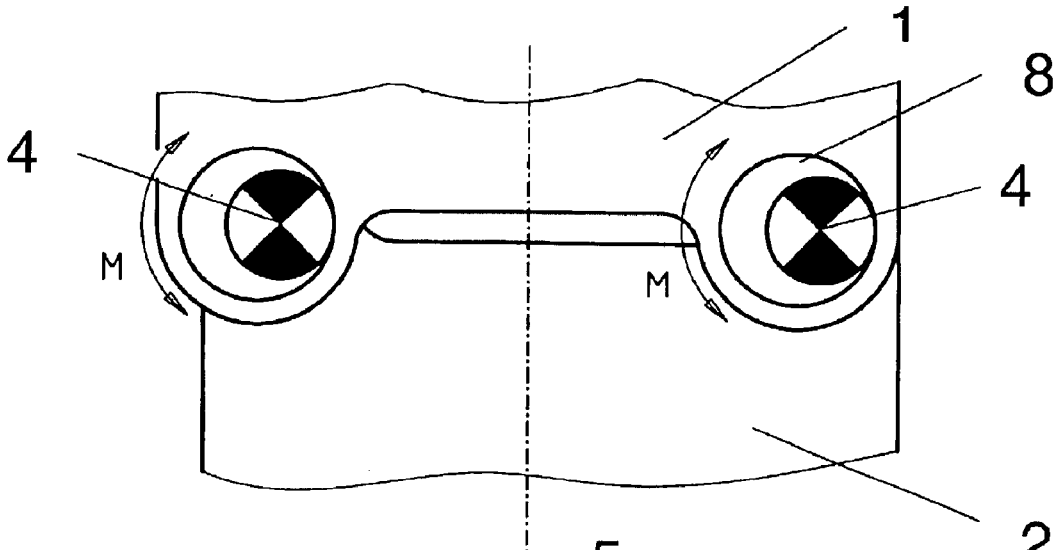
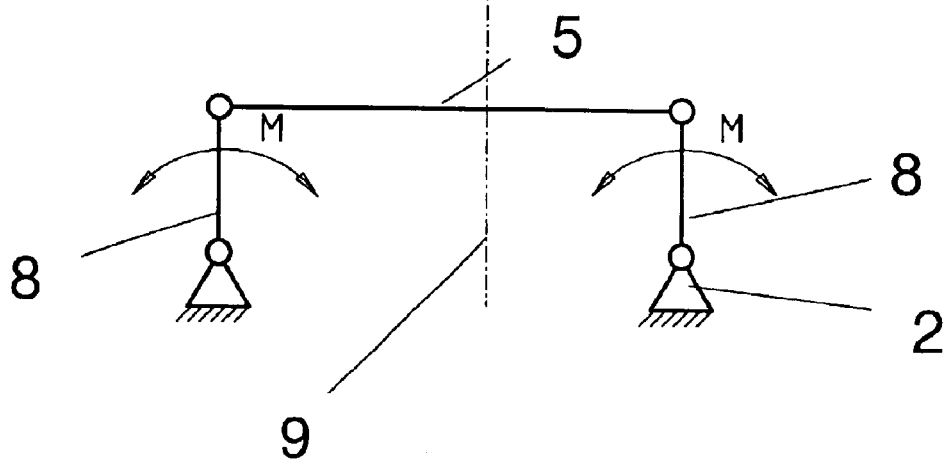
Fig. 2

DEVICE FOR DISPLACING THE CYLINDER BLOCK AND CYLINDER HEAD WITH RESPECT TO THE CRANKCASE

BACKGROUND OF THE INVENTION

The invention relates to a device for displacing the cylinder block and cylinder head versus the crankcase.

It is known to rate the compression ratio of Otto engines based on an anti-knocking property under full-load operating conditions. Under partial-load operating conditions of the internal combustion engine, the efficiency losses are accepted because higher compression ratios could be theoretically obtained in that range. To raise the compression ratio under partial-load operating conditions, the combustion chambers can be designed in a variable or shifting manner. The spacing between the piston and the cylinder head, and thus the volume of the combustion chamber and thereby also the compression ratio are changed by swiveling or displacing the entire cylinder head.

A device for displacing the cylinder block and cylinder head versus the crankcase to change the compression, on the engine block that has the type of construction described in the follow-wing, is known from European Patent Application EP 0 426 540 A1.

A crankcase that receives the crankshaft comprises setting (or adjusting) shafts with eccentrics that are supported on both sides of the crankshaft. These setting shafts are distributed over the length of the crankcases in an alternating manner and engage receiving bores of bearing bridges or bearing arms of the cylinder block that are arranged on both sides of the axis of the crankshaft. The cylinder block with the cylinder head forms a coupling member between the eccentrics and is displaced in relation to the crankshaft when the eccentrics are rotated. The straight line of connection between the axes of the setting shafts extends around the area of the crankshaft above or below the crankshaft and intersects the axis of the cylinder at a slanted or, according to FIG. 18, of EP 0426540 A1 at a right angle.

In addition, to duplicate the cylinder block and cylinder head versus the crankcase, the cylinder block can be pivot mounted on the one side at the level of the end of the cylinders sleeves in the crankcase. In addition, the cylinder block can be swivelled on the other side of the axis of the crankshaft via a crank drive supported on the crankcase. The cylinder block assumes positions that are closer to, or farther removed from the crankshaft to varying degrees, to change the compression in the engine (Auto-Zeitung 10/2000, pages 68–69, Heinrich Bauer Zeitschriften Verlag KG, Hamburg). A drawback of this design is the unfavorable introduction of force from the cylinder block into the crankcase and for typing up the transmission. The setting mechanism, which is formed as a crank drive consists of an eccentric shaft with connecting rods, and requires substantial installation space and a larger number of components. This design requires greater flexibility of the intake gas and exhaust gas system for compensating movements because of the pivoting movement of the cylinder block and cylinder head.

SUMMARY OF THE INVENTION

The invention is based on the problem of designing a device of the type specified above to displace the cylinder block and cylinder head vs. the crankcase with a stable support of the setting mechanism without having to accept any excessive weight increase.

The invention relates to a device for displacing a cylinder block and cylinder head vs a crankcase. The cylinder block contains cylinders having an axis. In this case, the device comprises a plurality of bearing bridges extending across the cylinder block between the cylinders in a substantially straight line that is substantially perpendicular to the cylinder axis. In this case, each of the plurality of bearing bridges have a plurality of bearing passages.

There are at least two setting shafts disposed in an upper region of the cylinder block in these bearing passages, and arranged in an alternating manner over a length of the crankcase. There are also a plurality of eccentrics which are coupled to the at least two setting shafts and supported on both sides of each of the cylinders. There are also a plurality of hollow support bars disposed in the cylinder block below the receiving bores.

The device contains a stable support of the setting mechanism for displacing the cylinder block and cylinder head versus the crankcase. This occurs by arranging and supporting the setting shafts with their eccentrics in the upper area of the cylinder block that is near the cylinder head, and by arranging the bearing passages (or tunnels) of the setting shafts in the crankcase above support bars that are formed as hollow supports. The stability of the crankcase structure is substantially increased by mounting the support bars, which are formed as hollow supports, in the upper area of the crankcase, so that the forces originating from the cylinder block can be absorbed and passed on without problems. The setting mechanism is arranged so that the straight line of connection of the bearing eyes or bearing arms (or brackets) of the cylinder block is positioned approximately perpendicular in relation to the cylinder axis, which results in a transmission parallelogram for displacing the cylinder block versus the stationary crankcase. Because of the high tie-up of the setting shafts, it is possible to arrange the required sealing (sealing flange, sealing sleeve) between the crankcase and the cylinder block above the tie-up of the transmission, without any lengthening of the engine by the sealing sleeve.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 1 is a schematic representation of the device for displacing the cylinder block and cylinder head versus the crankcase;

FIG. 2 shows a transmission circuit diagram of the device for displacing the cylinder block and cylinder head versus the crankcase;

DETAILED DESCRIPTION

Figure 3:
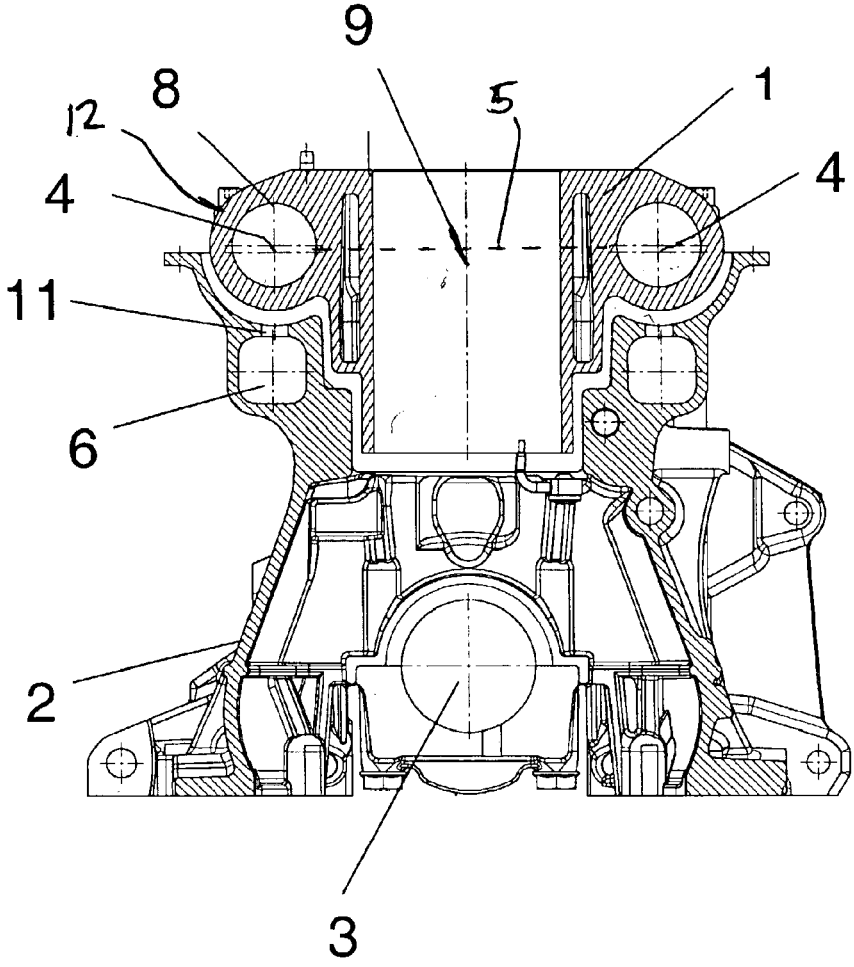
FIG. 3 is a cross-sectional view through the cylinder block with setting shafts and the crankcase.

Referring to the drawings, FIG. 1 shows a part of a cylinder block 1 and a crankcase 2 of an internal combustion engine, wherein cylinder block 1 is displaced versus crankcase 2 by setting shafts 4. This displacement occurs in association with eccentrics 8 arranged on setting shafts 4. At least one of the setting shafts 4 is driven in this connection via a motor (not shown). This motor is controlled via a motor controller for displacing the cylinder block accordingly. Cylinder block 1 is displaced with respect to crankcase 2 as shown in the prior art. Such displacement is not the object of the solution as defined by the invention.

Setting shafts 4 are arranged on both sides of the cylinders, extending in the upper area of cylinder block 1 that is close to the cylinder head. Setting shafts 4 are advantageously formed as one single piece. However, it is possible also to form setting shafts 4 in more than one piece such as in a structured manner. Setting shafts 4 are supported in crankcase 2 and eccentrics 8 are supported in cylinder block 1. Setting shafts 4 and their eccentrics 8 are arranged so that the straight line of connection 5 between bearing eyes or bearing arms of cylinder block 1 receiving setting shafts 4, and eccentrics 8 are positioned about perpendicular to cylinder axis 9 of the internal combustion engine. This means that the setting mechanism for displacing cylinder block 1 versus crankcase 2 represents a transmission parallelogram. The adjusting gearing for changing the volume of the combustion chamber of the internal combustion engine is schematically shown in FIG. 2.

FIG. 3 shows support bars 6 which are positioned in the upper area of crankcase 2. These support bars are formed as hollow supports for stabilizing crankcase 2 and for supporting in a stable manner, the setting mechanism that comprises setting shafts 4, eccentrics 8 and the servo-drive (not shown). Support bars 6 extend over the length of crankcase 2. Support bars 6 are in the form of hollow supports that assure the stability of crankcase 2 in a decisive manner.

A division of crankcase 2 in the plane of the crankshaft is not separately shown, so that the covers of the individual bearings are omitted and crankshaft 3 is supported in a lower part (bed plate) extending over the entire width of crankcase 2. The flow of force in crankcase 2 is straightened and stabilized by such an arrangement.

FIG. 3 shows a cross section through an internal combustion engine, showing the displacement of cylinder block 1 into its top position at the largest volume of the combustion chamber. Furthermore, FIG. 3 shows bearing arms 12 of the cylinder block for receiving the setting shaft bearing (eccentrics). Reference numeral 3 denotes the bearing tunnel of the crankshaft located in the crankcase 2. In addition, reference numeral 5 denotes a longitudinal axis which bisects bearing eyes of bearing arms or bridges 12 wherein this longitudinal axis extends substantially perpendicular to cylinder axis 9.

Figure 4:
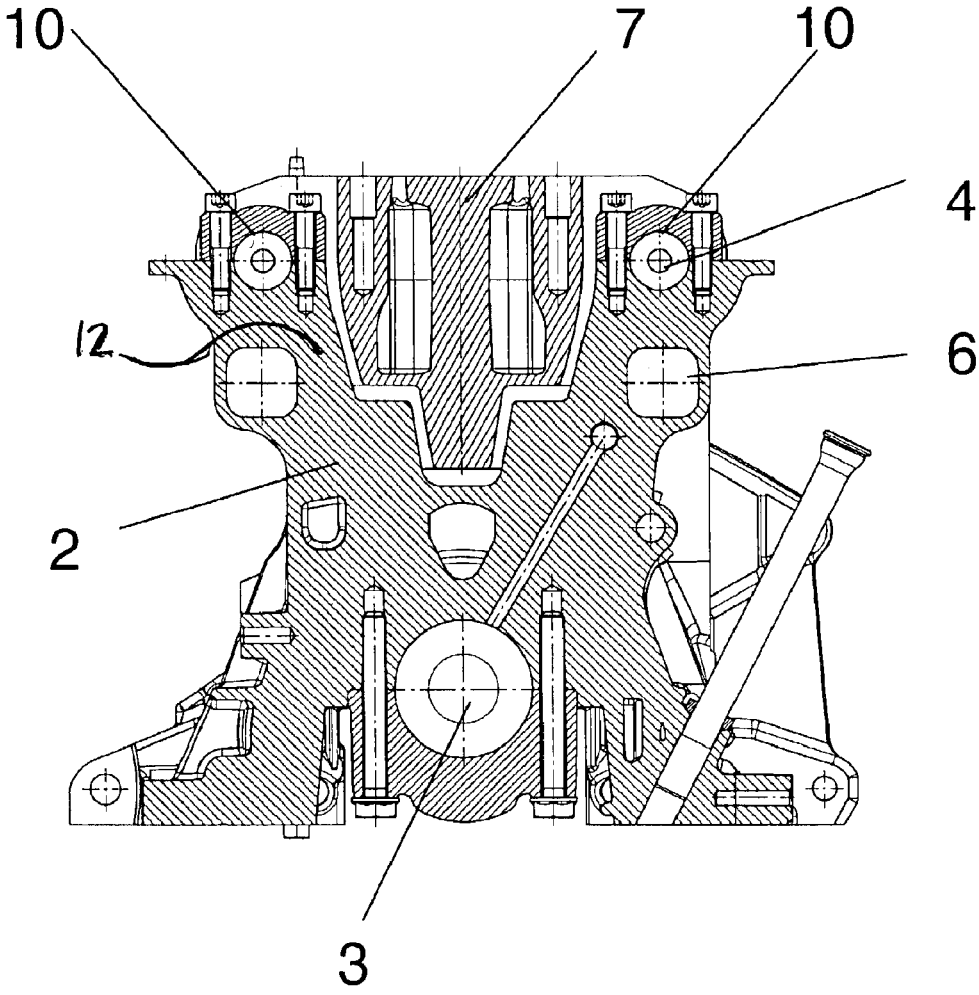
FIG. 4 is another cross-sectional view through the cylinder block with setting shafts and the crankcase.

FIG. 4 shows another cross section through an internal combustion engine which shows bridge 7 extending between the cylinder tubes, and the support of setting shafts 4 in crankcase 2.

To achieve low cylinder distortion, the arrangement of setting shaft 4 and eccentrics 8 as shown in FIGS. 3 and 4 can be created in a reversed manner if the stresses are high. In that case, bearing arms 12 of the cylinder block for supporting the setting shafts (eccentrics) are arranged in the area of bridge 7 extending between the cylinder tubes, and the setting shafts. Each of these bearing arms are supported in the plane of the cylinder centers.

To increase the stability in the engine, cylinder block 1 is made of gray cast iron, which reduces the wall thickness, or manufactured from vermicular cast. The consequent application of the higher strength of gray or vermicular cast can be beneficially used to create a lightweight construction to reduce the weight. With a divided design of cylinder block 1 and the head of the cylinder, the cylinder head may consist of aluminum as before. Another weight-reducing measure consists in forming setting shafts 4 as hollow shafts.

The hollow support bars 6 may be used to receive and pass on the return flow of oil from the cylinder head in a controlled manner. The return flow of oil is admitted in a controlled manner into the volumes of the support bars disposed below the setting shafts 4 via suitably positioned bores 11 (FIG. 3). The return flow of oil can be directly passed on into the oil sump via channels in the plane of the bearing block. These channels are not shown separately.

Figure 5:
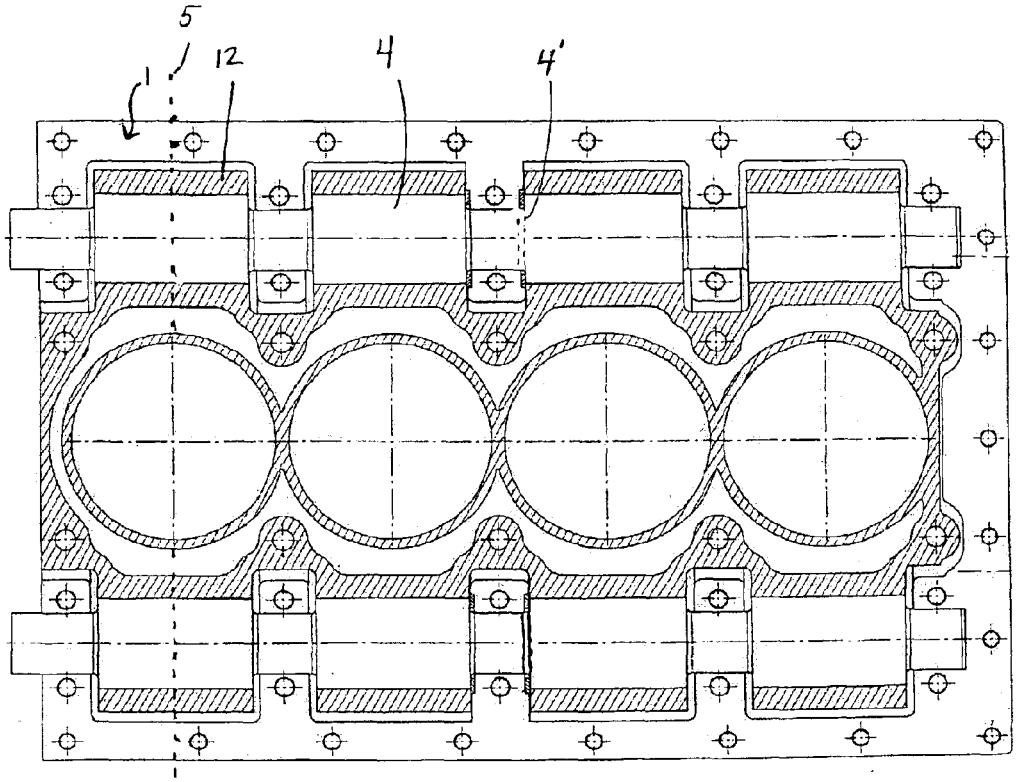
FIG. 5 is a top view of the device shown in FIGS. 2 and 3.

FIG. 5 shows a top view of the internal combustion engine showing setting shafts 4 extending through the engine 1 along a longitudinal axis 14. Bearing bridges 12 extend along longitudinal axis 5 which is perpendicular to the extension of each of the cylinder axes 9 in FIG. 3. Setting shafts 4 are preferably formed as one single piece extending along longitudinal axis 14. However, an optional embodiment shown by reference numeral 4' shows that setting shafts 4 can be formed as more than one piece such as in a structured manner.

Accordingly, while at least one embodiment of the present invention has been shown and described, it is to be understood that many changes and modifications may be made thereunto without departing from the spirit and scope of the invention as defined in the appended claims.

What is claimed is:

1. A device for displacing a cylinder block and cylinder head vs. a crankcase, the cylinder block containing cylinders having an axis, the crankcase having receiving bores, the device comprising:

a) a plurality of bearing bridges extending across the cylinder block adjacent to the cylinders wherein each bearing bridge has a longitudinal axis that extends substantially perpendicular to each cylinder axis, wherein each of said plurality of bearing bridges have a bearing passage;

b) at least two setting shafts disposed in an upper region of the cylinder block in said bearing passages, and extending over a length of the crankcase;

c) a plurality of eccentrics being coupled to said at least two setting shafts and supported on both sides of each of the cylinders; and d) a plurality of hollow support passage disposed in the cylinder block below the receiving bores.

2. The device as in claim 1, wherein the crankcase is made of a relatively lighter metal than gray cast iron and wherein a bearing passage of said crankshaft and said bearing passages of said at least two setting shafts are made from gray cast iron.

3. The device as in claim 1, wherein said bearing passages of said at least two setting shafts in the crankcase comprises a lighter metal than gray cast iron.

4. The device as in claim 1, wherein said at least two setting shafts are made from single piece components.

5. The device as in claim 1, wherein said at least two setting shafts are made from multi-part components.

6. The device as in claim 1, wherein said crankcase is divided into two different regions, a lower portion, and an upper portion, wherein a lower portion of the crankcase receiving the crankshaft is in the form of a plurality of bearing bridges.

7. The device as in claim 1, wherein said crankcase is divided into two different regions, a lower portion and anupper portion, wherein a lower portion of the crankcase receiving the crankshaft is in the form of a bed plate.

8. The device as in claim 1, wherein the cylinder block is comprised of gray cast iron.

9. The device as in claim 1, wherein said at least two getting shafts are hollow.

10. The device as in claim 1, wherein the cylinder block has a plurality of bores for receiving oil, and said plurality of hollow support bars are in communication with said plurality of bores to receive and recycle oil through said plurality of bores from an oil sump disposed in the crankcase.

* * * * *